US008931634B2

(12) United States Patent
Anderson

(10) Patent No.: US 8,931,634 B2
(45) Date of Patent: Jan. 13, 2015

(54) DRINKING STRAW FOR DISPENSING SUBSTANCES WITH ONE-WAY VALVE

(71) Applicant: Michael R. Anderson, Deerfield Beach, FL (US)

(72) Inventor: Michael R. Anderson, Deerfield Beach, FL (US)

( * ) Notice: Subject to any disclaimer, the term of this patent is extended or adjusted under 35 U.S.C. 154(b) by 0 days.

(21) Appl. No.: 13/862,599

(22) Filed: Apr. 15, 2013

(65) Prior Publication Data

US 2013/0270357 A1 Oct. 17, 2013

Related U.S. Application Data

(63) Continuation of application No. 11/534,002, filed on Sep. 21, 2006, now abandoned.

(51) Int. Cl.
*B65D 25/08* (2006.01)
*A47G 21/18* (2006.01)

(52) U.S. Cl.
CPC ..... *A47G 21/18* (2013.01); *A47G 21/183* (2013.01); *A47G 2400/027* (2013.01)
USPC ..... 206/219; 239/33; 426/85

(58) Field of Classification Search
USPC ..... 206/219, 221; 220/705, 703, 220/706–710.5; 426/85, 134, 590; 239/33, 239/16, 24; 215/229, 388
See application file for complete search history.

(56) References Cited

U.S. PATENT DOCUMENTS

| | | | | |
|---|---|---|---|---|
| 3,438,527 | A | 4/1969 | Gamblin, Jr. | |
| 3,824,322 | A * | 7/1974 | Fiorella | 426/134 |
| 4,196,747 | A | 4/1980 | Quigley et al. | |
| 4,581,013 | A | 4/1986 | Allen | |
| 4,981,468 | A * | 1/1991 | Benefiel et al. | 604/83 |
| 6,050,444 | A | 4/2000 | Sugg | |
| 6,109,538 | A | 8/2000 | Villani et al. | |
| 2003/0042324 | A1 * | 3/2003 | Ho | 239/33 |
| 2003/0203075 | A1 | 10/2003 | Taylor | |
| 2003/0218076 | A1 * | 11/2003 | Farnsworth et al. | 239/33 |
| 2004/0188280 | A1 | 9/2004 | Young | |
| 2005/0029271 | A1 * | 2/2005 | McDonough | 220/709 |
| 2005/0061822 | A1 * | 3/2005 | Naesje | 220/705 |
| 2005/0150894 | A1 * | 7/2005 | Stribling et al. | 220/705 |
| 2005/0242204 | A1 * | 11/2005 | Ness et al. | 239/24 |

* cited by examiner

*Primary Examiner* — Jacob K Ackun
*Assistant Examiner* — Jenine Pagan
(74) *Attorney, Agent, or Firm* — Malin Haley DiMaggio & Bowen, P.A.

(57) ABSTRACT

A drinking straw that can be used to dispense a substance such as vitamins, pharmaceuticals, or diet supplements that is stored inside of the straw body. The straw includes a one-way liquid flow valve at one end of straw that prevents drawn liquid and any of the dissolved materials from returning to the initial liquid source that is drawn through the straw when the straw is not in use. The straw may include a one-way valve or crimp for acting as a one-way valve.

1 Claim, 4 Drawing Sheets

DRINKING STRAW FOR DISPENSING SUBSTANCES WITH ONE-WAY VALVE

CROSS REFEERNCE TO RELATED APPLICATIONS

This application is a continuation of co-pending U.S. patent application Ser. No. 11/534,002 filed Sep. 21, 2006.

BACKGROUND OF THE INVENTION

1. Field of the Invention

This invention relates generally to drinking straws used for consuming beverages and other liquids. A straw contains one or more ingredients that are dissolved and dispensed during drinking as the liquid is sucked through the straw and a one-way valve.

2. Description of Related Art

The use of drinking straws, paper or plastic, have been know in the prior art for quite some time. Drinking straws provide a sanitary device for ingesting liquids from containers such as bottles or glasses that allow the user not to put user's mouth or lips on the glass or bottle container. Drinking straws have also been utilized for dispensing materials that may be formed on the inside of the straw that dissolve during drinking when the liquid is sucked through the straw by the user.

One of the drawbacks of a dispensing drinking straw is that not all of the liquid in the straw is evacuated during each use of the straw. When the straw user stops drawing in, a certain amount of liquid in the straw returns back into the contents of the bottle or container from which the liquid is being drawn. This is an undesirable characteristic because the liquid in the straw includes the substance being dissolved. The dissolved substance should not be allowed to flow into the primary liquid source container.

The present invention overcomes these problems by providing a drinking straw that dispenses one or more substances or ingredients that have been deposited on the inside of the straw by using a one-way flow valve at the base of the drinking straw that prevents any of the contents, once received into the drinking straw, from being received back into the initial liquid container.

SUMMARY OF THE INVENTION

A drinking straw for dispensing one or more ingredients that are deposited on the inside passage of said straw that prevents return of any liquid once received into the straw from returning into the initial liquid container comprising an elongated hollow cylindrical tube made of plastic or paper sized in diameter for drawing a liquid therethrough by a human user, a dissolvable substance mounted in certain areas on the inside surface of said hollow tube for contact with the liquid drawn through the straw during use for dissolving the substance, and a one-way valve mounted at the bottom end of the straw that allows liquid to be sucked and drawn through the valve in one direction but closes and prevents the liquid from falling by gravity back through in the other direction in the straw.

In one embodiment, the straw body may be made of plastic and having a diameter of approximately ⅜ of an inch and be fairly rigid. Small dissolvable beads of material are disposed on the inside surface of the straw and spaced apart so that liquid can be drawn through the straw in a normal manner by the user but allowing a certain amount of substances to be dissolved into the liquid during the drawing operation.

The one-way valve is disposed near the base or the bottom area of the dispensing straw. In one embodiment the valve could include a small circular flapper disk that lifts and opens under the pressure or suction caused by the user drawing the liquid out of the bottle. When the suction stops, the circular flapper disk will fall by gravity into a closed position preventing any liquid in the straw from returning back into the initial container from which the liquid was drawn thereby preventing the dissolved substances that are trapper inside the straw from exiting the base of the straw.

In an alternate embodiment to further enhance the containment of liquid in the straw, the straw body can be pressed close together at each end to act as a liquid restrictor but still permit liquid to flow therethrough under suction when the user sucks on the moist straw bulbous end. This crimping of the straw at each end forms an internal chamber that contains a dissolvable substance that cannot pass through the crimped areas of the straw. However, the liquid still can pass through the crimped areas when the straw is in operation (suction) allowing loose beads to be trapped in a straw for dissolution during operation.

It is an object of this invention to provide an improved drinking straw that allows for dispensing one or more substances that dissolve into the liquid being consumed during the straw operation without allowing liquid trapped inside the straw from returning to the original container when the drawing operation of the straw is stopped by the user.

In accordance with these and other objects which will become apparent hereinafter, the instant invention will now be described with particular reference to the accompanying drawings.

PREFERRED EMBODIMENT OF THE INVENTION

Figure 1:
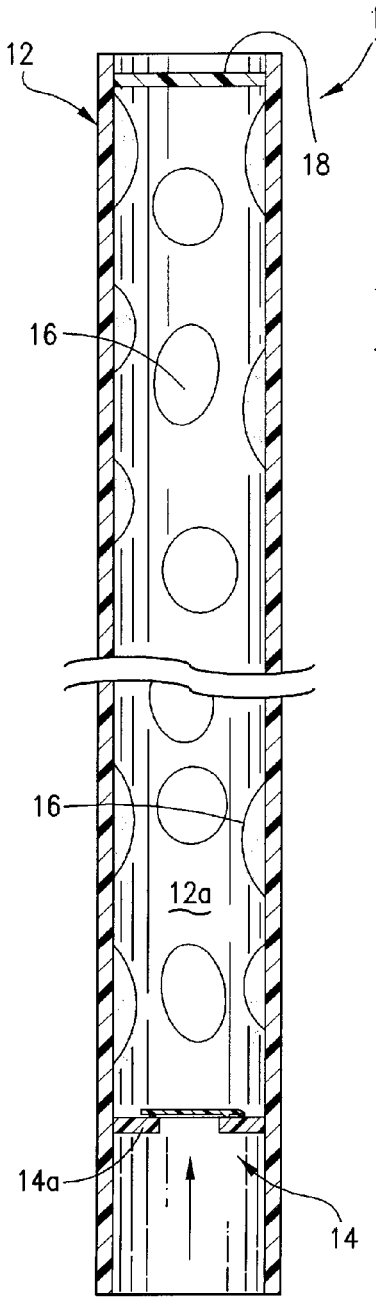
FIG. 1 shows a front elevational view of a straw of indeterminate length in cross section of the present invention.

Referring now to the drawings and, in particular, FIG. 1, an embodiment of the invention is shown generally at 10 comprised of a hollow tubular straw body 12 which could be paper, plastic or other type suitable material that is stiff enough to act as a self-supporting straw that includes a hollow passage or chamber 12*a* to aid liquid flow therethrough. The straw inside chamber 12*a* is permeated with a substance or chemical 16 that is dissolvable in a liquid being drawn through the straw. The substances 16 can be any type of medicine, vitamin or other ingredient that is coated along the inside chamber 12*a* wall or deposited in separate beads 16 along the inside passage walls of passage 12*a* in the straw.

At the bottom or lower end of the straw 12, there is a one-way liquid flow valve 14 with a valve base 14*a* mounted inside the straw 12. Valve 14 allows liquid to be drawn up through the straw 12 when a person is drinking, as shown by the arrow. While a user is drawing liquid, the one-way valve 14 would be open, allowing the upward flow of liquid into the user's mouth. In the non-use position as shown in FIG. 1, when the user has stopped drawing on the straw, the valve 14 is closed by gravity, trapping the liquid and dissolved substance remaining inside the straw passage 12*a*, preventing any residual liquid and substance 16 in the straw chamber 12*a* from entering or returning to the original liquid container.

The primary purpose of the straw 10 as shown in FIG. 1 is to allow a user drawing a liquid through the straw 12 to obtain the benefit of the dissolved substances 16. As the substances 16 dissolve, the liquid with the dissolved substances enters the user's mouth. However, if the user does not consume the entire liquid in the container being drawn at one time, each time the user stops sucking on the straw, the valve 14 prevents the liquid trapped in the straw in passage 12*a* including the dissolved substances 16 from being transferred by gravity back into the original liquid container that houses the straw 12. The one-way valve 14 will close preventing any of the dissolved substances 16 from being received into the primary liquid source (not shown). A circular screen 18 is mounted inside passage 12*a* at the top of the straw to prevent large particles of substance 16 from leaving the passage 12*a* before being dissolved.

Figure 2:
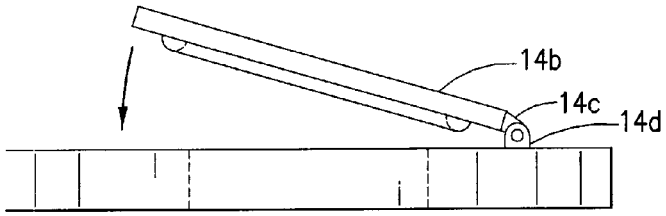
FIG. 2 shows a side elevational view of the one-way valve used with the invention.
Figure 3:
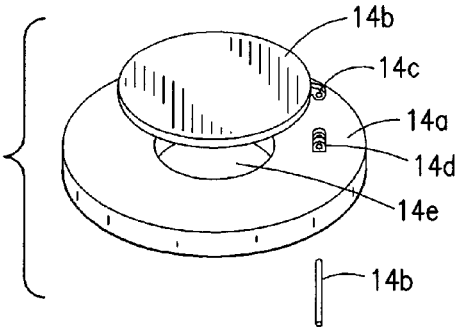
FIG. 3 shows a perspective, exploded view of the one-way valve of FIG. 2.

Referring now to FIGS. 2 and 3, a one-way valve is shown (outside of the straw) having a valve base 14*a* that in operation is attached to the inside wall of the straw (inside passage 12*a*) perpendicular to the longitudinal axis of the straw. The valve base 14*a* includes an aperture 14*e* that is smaller in diameter than the movable flap disk 14*b* which is a thin, flexible plastic disc that is large enough in diameter to completely cover the valve base aperture 14*e* in the closed position. The flap disk 14*b* can be permanently affixed to base 14*a* with hinge 14*d* and a tab 14*c* that is flexible that allows slight upward movement of the flap disk 14*b* with a pin 14*f* when liquid is being drawn upwardly through the straw and through the one-way valve 14. Thus, when liquid is being drawn upwardly by a user in the straw 12, flap disk 14*b* will raise enough to permit liquid flow through aperture 14*e* of one-way valve 14. However, whenever there is no force of liquid being drawn upwardly, gravity on the liquid in the straw will push downwardly on the flap disk 14*b* sealing the disk 14*b*, against the upper surface of base 14*a* of the valve, preventing liquid in passage 12*a* from returning downwardly to the original container.

Although one type of one-way valve is shown mounted in the straw as valve 14, other types of known one-way valves could be used to accomplish the same result which is to prevent the downward flow of liquid that contains the dissolved substances 16 when the straw is not being used.

Figure 4:
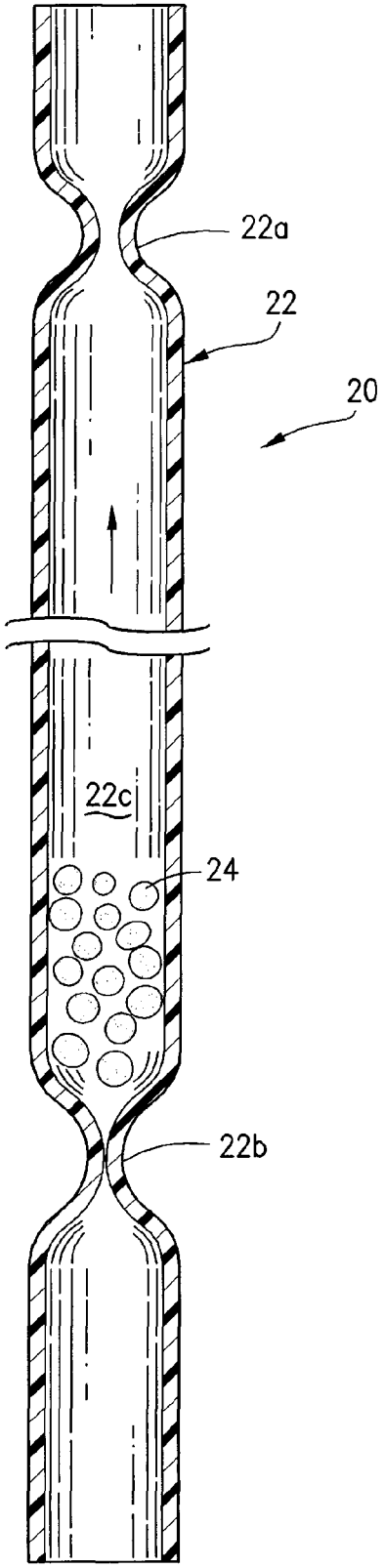
FIG. 4 shows a side elevational view in cross section of an alternate embodiment of the present invention.

Referring now to FIG. 4, an alternate embodiment of the invention is shown. A straw 20 containing dissolvable substances 24 that could be medicines, vitamins or other desirable substances are trapped in a compartment 22*c* between the upper crimp 22*a* of straw 22 and the lower crimp 22*b*. The materials 24, therefore, cannot be removed from the straw because of the narrow or non-existent diameter of straw 22 at the crimps 22*a* and 22*b*.

However, when the straw 20 is used and liquid is being drawn upwardly as shown by the arrow through passage 22*c*, the dissolvable substances 24 will rise slowly and crimp 22*b* will open sufficiently (through the resilience of the straw body material) to allow liquid to pass through crimp 22*b* and over substances 24 which dissolve slowly. Crimp 22*a* will open slightly but not enough to allow beads 24 to pass through crimp 22*a* or fall through crimp 22*b*.

Because crimp 22*b* and 22*a* both have memory, the plastic straw 22 material will return to its resilient original position shown in FIG. 4 as closed once the liquid is stopped being drawn through the straw 22. The effect of the lower crimp 22*b* is to prevent (when the straw is not in use) any liquid flowing downwardly because the crimp 22*b* has effectively sealed the base of the straw since there is no force on crimp 22*bit* other than gravity when straw is not in use Likewise, if the straw is moved around or tipped upside down, crimp 22*a* will prevent any of the substances 24 from being removed from the straw. Various crimp shapes could be used including square, triangle, octagon or star-shaped in cross section of the straw.

The straw body can include perforated segments that allow the entire straw to be rolled up or bent in segments for packaging. The top of the straw open end could be sealed with a foil cover that is removed at the time of use.

Figure 5:
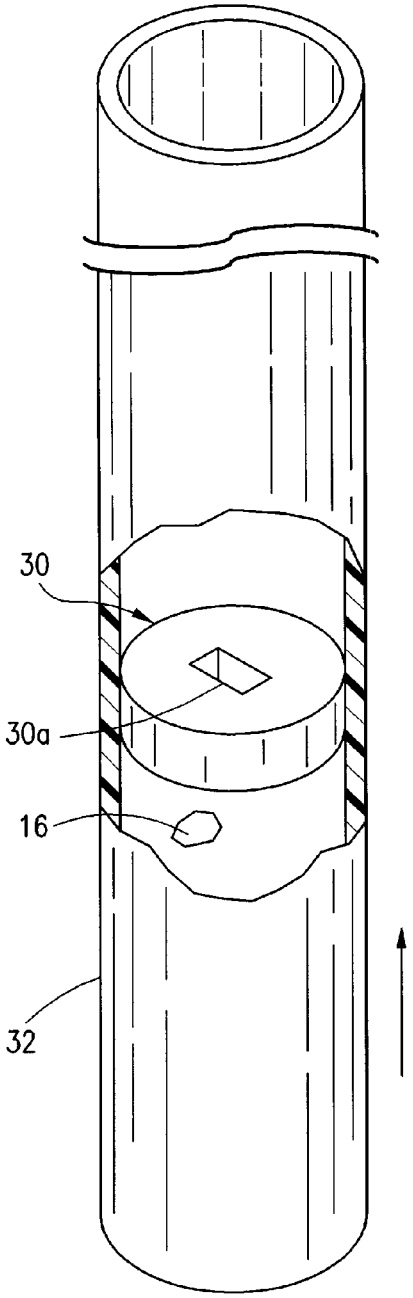
FIG. 5 shows an alternate embodiment of a one-way valve used in the present invention.

Referring now to FIG. 5, an alternate embodiment of the one-way valve is shown in straw 32 that includes a base 30 which is a cylindrical disc having a narrow trapezoidal or tapered opening 30*a* that allows fluid to flow in the direction of the arrow when the user is sucking on the straw 32 while, at the same time, preventing liquid from flowing in the downward direction. The dissolvable material 16 is shown mounted above valve 30. The valve may be made of a resilient material that allows the slotted opening 38 to open and close in response to pressure placed on the valve. The valve 30 has been described in U.S. Pat. No. 6,050,445 issued Apr. 18, 2000.

Figure 6:
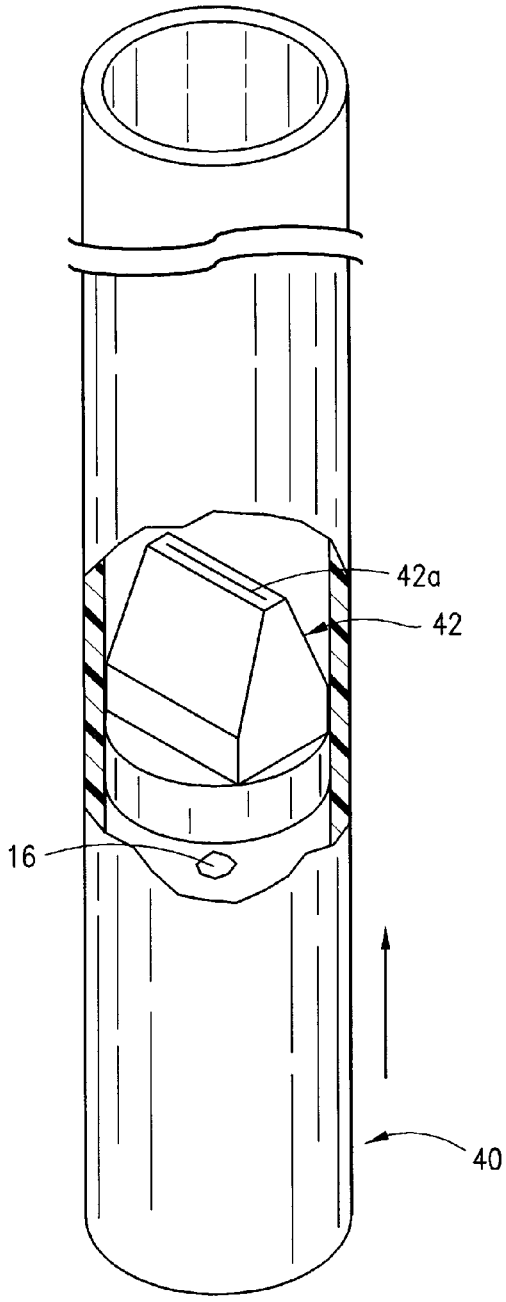
FIG. 6 shows a perspective view partially cut away of yet another alternate embodiment of a one-way valve used in the present invention.

Another alternate one-way valve for fluid is shown in FIG. 6. Straw 40 includes valve 42 which has a very thin passageway 42*a* through the entire valve body 42. The valve body 42 is very resilient and under pressure of suction from the user of the straw 40, liquid will be drawn upward in the direction of the arrow through passageway 42 which opens slightly enough due to the suction pressure of the user. Again, the dissolvable material 16 that is mounted above the valve 42 will not be allowed to go backwards into the liquid source because of valve 42. Again, valve 42 is shown in U.S. Pat. No. 6,050,445 issued Apr. 18, 2000.

Figure 7:
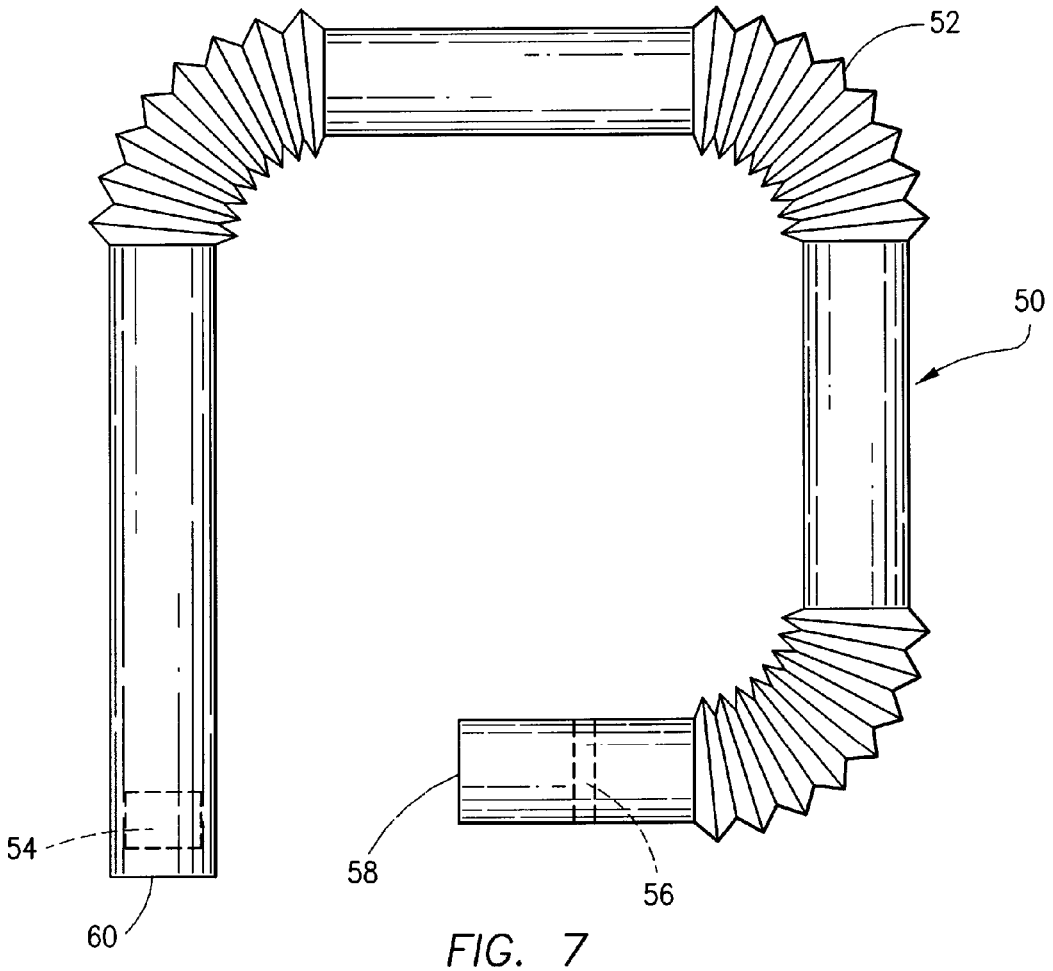
FIG. 7 is a side elevational view of an alternate embodiment.

Referring now to FIG. 7, an alternate embodiment of a straw is shown that includes a plurality of bendable sections 52 connected at strategic locations of straw 50 that allows a straw to be bent in almost a 360 degree configuration. In this configuration, the straw can be mounted or connected to a liquid container or a package on the outside or any other convenient storage position prior to the straw's use. The straw includes a one-way valve 54 described above near straw base 60. The top end 58 of the straw 50 may include a screen 56 to retain the interior solid particles that have been described above in the straw body passage.

Other configurations are possible in that the entire bendable section 52 could exist throughout the entire body of the straw 50 so that the straw literally could be configured into a circle for storage.

Although the straw interior passage has been shown having segments of dissolvable material attached on the inside surface, the passage wall could be coated entirely with a dissolvable substance that will dissolve when liquid is drawn through the straw during operation.

In summary, the invention provides a dispensing straw that allows one to dispense one or more substances previously deposited on/or stored in a chamber in the straw that when a liquid is drawn through the straw, the substances can dissolve during the drawing action. When the straw is not in use, the liquid previously retained in the straw during the drawing action will not be returned to the original container that the straw is in preventing any of the dissolved substances from being received into the liquid that is the primary source of liquid being drawn by the user.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A dispensing drinking straw for containing a substance that can be dissolved in a liquid drawn through the dispensing drinking straw comprising:

a drinking straw body that includes a long, thin hollow cylinder, for drinking a liquid, said drinking straw body being crimped near a first top end forming a first crimp and said straw body being crimped near a second bottom end forming a second crimp, and forming an interior chamber between said first crimp and said second crimp; and a substance deposited in the chamber formed between the first crimp and the second crimp in the straw body, said second straw body crimp having memory so that the force of liquid through the straw will open the crimp to permit liquid to flow there through and when the drawing force of liquid is removed, the second crimp will return to its original closed position.

* * * * *